US005601193A

United States Patent [19]

Santoya

[11] Patent Number: 5,601,193

[45] Date of Patent: Feb. 11, 1997

[54] DESK ORGANIZER

[76] Inventor: Philip L. Santoya, 37-20 81st. St. Apt. 1K, Jackson Heights, N.Y. 11372

[21] Appl. No.: 342,887

[22] Filed: Feb. 27, 1995

[51] Int. Cl.[6] ..... A47F 5/00

[52] U.S. Cl. ..... 211/11; 211/13; 211/45

[58] Field of Search ..... 211/13, 11, 10, 211/45, 50; D19/21, 22, 23, 78, 88, 95

[56] References Cited

U.S. PATENT DOCUMENTS

| | | | |
|---|---|---|---|
| 2,222,190 | 11/1940 | Wolf | 211/11 X |
| 4,082,190 | 4/1978 | Merz | 211/11 |
| 4,176,743 | 12/1979 | Fitzpatrick | 211/13 X |
| 4,314,418 | 2/1982 | Narens et al. | 211/11 X |
| 4,802,593 | 2/1989 | Ramanos | 211/10 |
| 5,042,670 | 8/1991 | Timberlake | 211/10 X |

*Primary Examiner*—Robert W. Gibson, Jr.

[57] ABSTRACT

A base plate supporting a plurality of spaced vertical stands, such stands mainly, in turn, also supporting a plurality of note clips thereon, and thereby providing a means for isolating notes placed in such clips to permit designating areas of urgency of action denoted by such notes. One of the vertical stands is provided with a rotatable ring holder to permit placing more notes in a small space than otherwise possible. Another stand is in the form of a cylindrical pedestal to permit the placing of a decorative object such as a vase of flowers thereon.

6 Claims, 4 Drawing Sheets

FIG 1
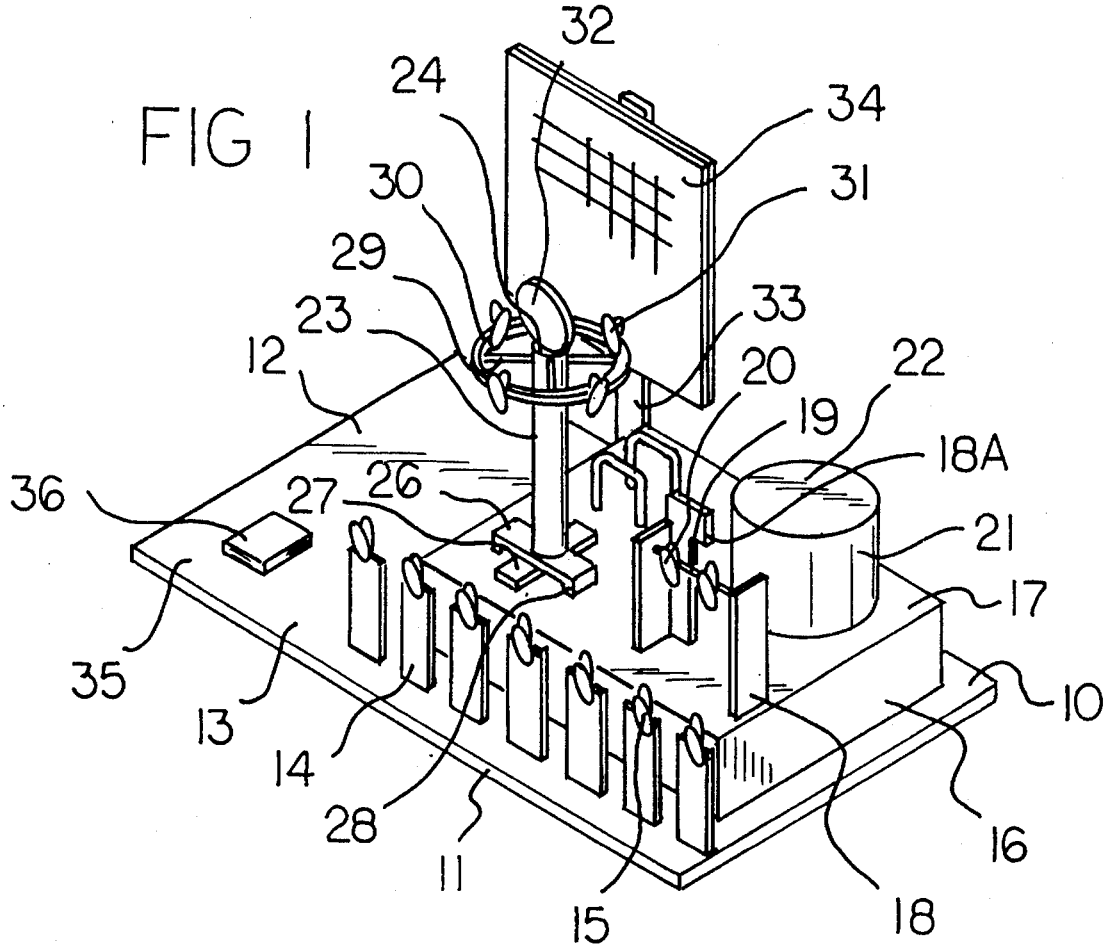
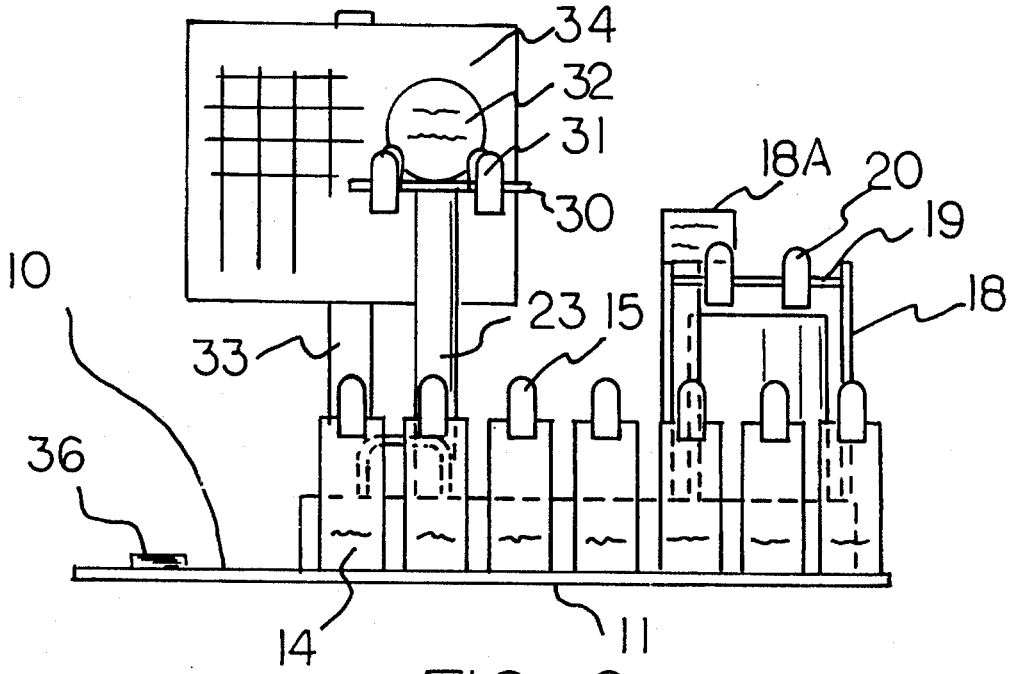
FIG 2

DESK ORGANIZER

BACKGROUND OF THE INVENTION

1. Field of the Invention

The present invention relates to desk organizers and more particularly pertains to devices which may be used to keep clutter off desks or other worksurfaces.

2. Description of the Prior Art

The use of organizers is known in the prior art. More specifically, such devices heretofore devised and utilized for the purpose of organizing a desk are known to consist basically of familiar, expected and obvious structural configurations, notwithstanding the myriad of designs encompassed by the crowded prior art which have been developed for the fulfillment of countless objectives and requirements. Typical of such constructions are those shown in U.S. Pat. Nos. 5,197,614; 5,152,405; 4,003,471; 3,675,782; and 3,425,566. These generally provide for limited, if any, delineation of separate areas to identify degrees of urgency for the contents thereof.

In this respect, the organizer according to the present invention substantially departs from the conventional concepts and designs of the prior art, and in so doing provides a structure primarily developed for the purpose of providing at a glance an overall view of the sequence of actions to be taken as specified on the organizer unit.

Therefore, it can be appreciated that there exists a continuing need for new and improved organizers which can be programed to illustrate for the user the actions to be taken and when, in relation to the present. In this regard, the present invention substantially fulfills this need.

SUMMARY OF THE INVENTION

In view of the foregoing disadvantages inherent in the known types of organizers now present in the prior art, the present invention provides an improved organizer construction wherein the same can be utilized as described above. As such, the general purpose of the present invention, which will be described subsequently in greater detail, is to provide a new and improved organizer which has all the advantages of the prior art devices and none of the disadvantages.

To attain this, the present invention essentially comprises a base plate supporting a plurality of spaced vertical stands, such stands mainly, in turn, also supporting a plurality of note clips thereon, and thereby providing a means for isolating notes placed in such clips to permit designating areas of urgency of action denoted by such notes. One of the vertical stands is provided with a rotatable ring holder to permit placing more notes in a small space than otherwise possible. Another stand is in the form of a cylindrical pedestal to permit the placing of a decorative object such as a vase of flowers thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved desk organizer which has all the advantages of the prior art devices and none of the disadvantages.

It is another object of the present invention to provide a new and improved desk organizer which may be easily and efficiently manufactured and marketed.

It is a further object of the present invention to provide a new and improved desk organizer which is of a durable and reliable construction.

An even further object of the present invention is to provide a new and improved desk organizer which is susceptible of a low cost of manufacture with regard to both materials and labor, and which accordingly is then susceptible of low prices of sale to the consuming public, thereby making such organizers economically available to the buying public.

Still yet another object of the present invention is to provide a new and improved desk organizer which provides in the apparatuses and methods of the prior art some of the advantages thereof, while simultaneously overcoming some of the disadvantages normally associated therewith.

Still another object of the present invention is to provide a new and improved free-standing desk organizer.

Yet another object of the present invention is to provide a new and improved desk organizer which affords separate areas for memos of different degrees of urgency.

Even still another object of the present invention is to provide a new and improved desk organizer which gives the user at a glance an over-all picture of what needs to be done and when.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the organizer unit in its entirety.

FIG. 2 is a front plan view of the unit shown in FIG. 1.

DESCRIPTION OF THE PREFERRED EMBODIMENT

Figure 3:
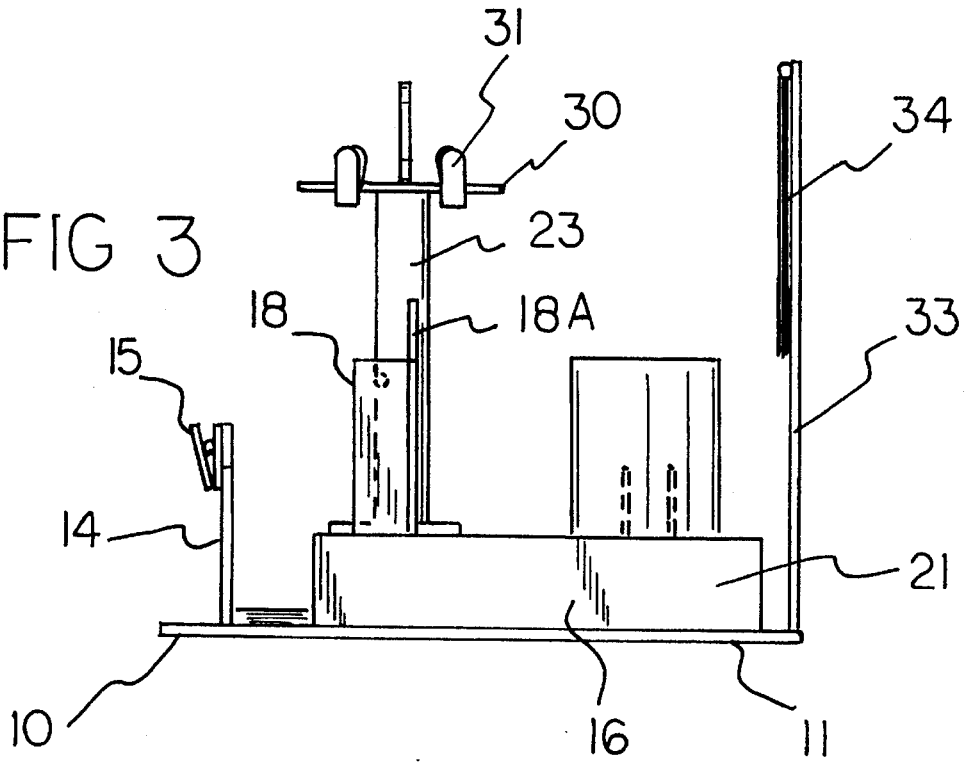
FIG. 3 is a side plan view of the unit shown in FIG. 1.

With reference now to the drawings, and in particular to FIG. 1 thereof, a new and improved desk organizer embodying the principles and concepts of the present invention and generally designated by the reference numeral 10 will be described.

More specifically, it will be noted that the organizer 10 comprises a flat, preferably rectangular, base member designed to be placed on a desk top or other working surface. Mounted on the upper surface 12 of base member 11 are a plurality of vertically extending support members of various types as described herein after. Adjacent the forward or front edge 13 of surface 12 and affixed thereto is a spaced row of small vertical rigid members forming miniature clip boards 14, each such board member 14 having affixed to the top edge thereof a small spring-loaded note clip 15. There are seven in number of such board members 14, each bearing indicia identifying a specific day of the week, the area encompassed by such board members 14 being referred to as the "daily affairs area". Immediately behind such daily affairs area is a raised rectangular box-like structure 16, affixed to the surface 12 of base member 11, such structure 16 having a solid top surface 17 thereon, and thereby forming a second level for the organizer unit 10. Mounted on such second level formed by structure 16 are the remaining vertical members of organizer 10. Spaced behind the row of board members 14 and anchored to the surface 17 are a pair of small, rectangular support members 18 extending vertically from such surface 17 at right angles to the board members 14 arrayed in front of and below members 18. A small diameter rod 19 supporting a pair of note clips 20 thereon extends between and connects members 18 one to the other. Preferably, affixed to one of the members 18 is an indicia supporting post 18-A bearing indicia identifying the area encompassed by members 18 as the area of "pending affairs". Directly behind the pending affairs area is a cylindrical pedestal 21 affixed to and extending upwardly from surface 17. This provides a support surface 22, preferably for a decorative item such as a vase of flowers (not shown). The final note-deliniation area designated for "urgent affairs", comprises a vertically extending shaft 23 having a rotatable collar 24 adjacent its upper end and terminating in and affixed to at its lower end a stabilizing foot member 25. Member 25 comprises a pair of flat horizontally extending members 26 and 27 extending at right angles to each other. Since one such member, 26, crosses the other member 27, a pair of depending feet 28 of the same vertical dimension as the thickness of member 27 are mounted to each end of member 26 in order to provide a stable support for shaft 23 where member 25 contacts surface 17. Member 25 may either be permanently secured to base surface 17 or may be detachable therefrom if desired. Affixed to collar 24 by struts 29 and rotatable therewith is a ring member 30 which supports a plurality of note clips 31. Extending upwardly from the top of shaft 23 is a vertical disc 32 which serves to supply an indicia surface identifying this area as "urgent affairs". A final vertical member 33 extends up from and is affixed to the rear edge of surface 12 and serves to support a calendar 34 thereon. Space is preferably left to one side of the surface 12 of base member 11 as shown at 35 to permit positioning thereon office supplies such as pens, tape, paper clips and the like as well as a supply of note paper as shown at 36.

FIGS. 2 and 3 show respectively front and side views of the organizer unit 10 with the elements thereof being identified by the same numbers as in FIG. 1.

Figure 4:
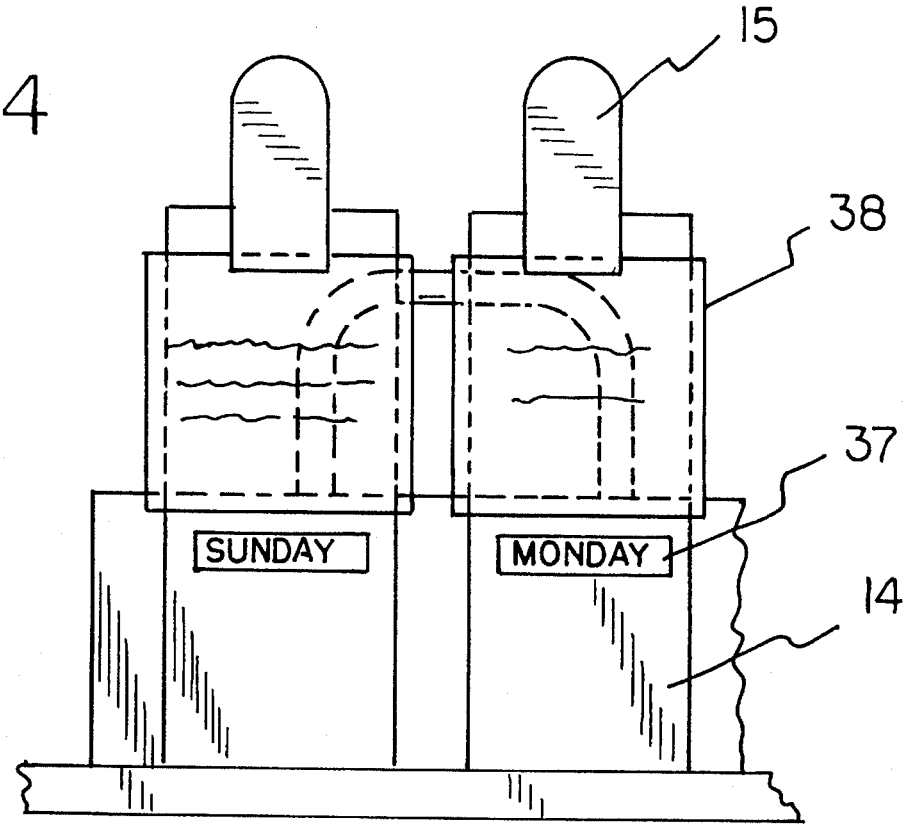
FIG. 4 is a front plan view of a portion of such unit.

FIG. 4 is an enlarged front view of a portion of the row of board members 14 showing the manner in which the identifying day insignia 37 is placed thereon, and notes 38 are positioned in clips 15.

Figure 5:
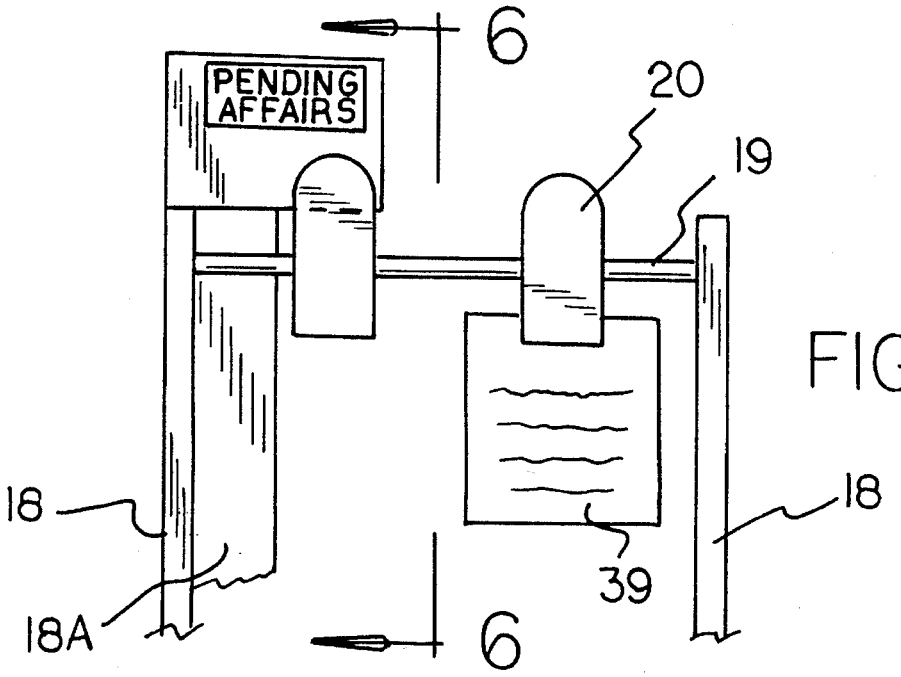
FIG. 5 is a front plan view of another portion of such unit.
Figure 6:
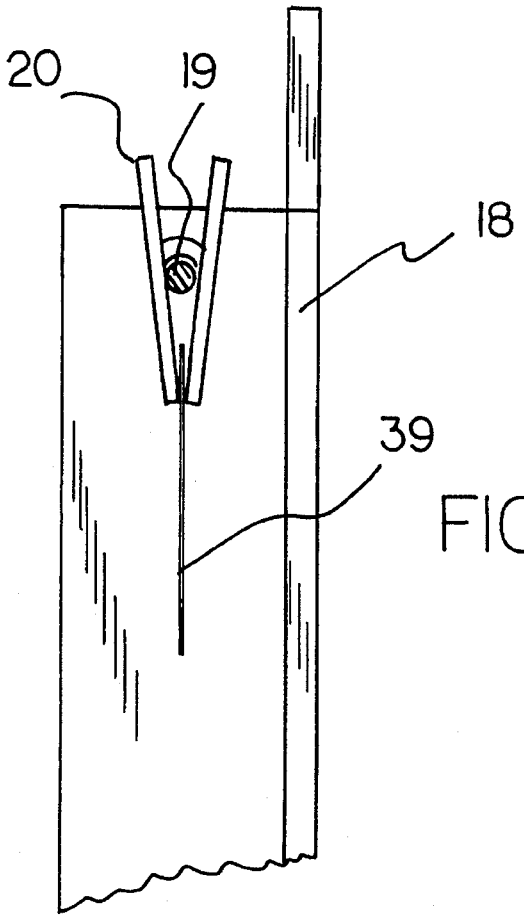
FIG. 6 is partially sectioned side view on line 6—6 of FIG. 5.

FIG. 5 is an enlarged front view of the "pending affairs" area showing the two support members 18, the connecting rod member 19 with associated note clips 20, and also the positioning of the "pending affairs" indicia on the post 18-A. Also shown is a note 39 fastened in one of the note clips 20, while FIG. 6 shows a detail view thereof.

Figure 7:
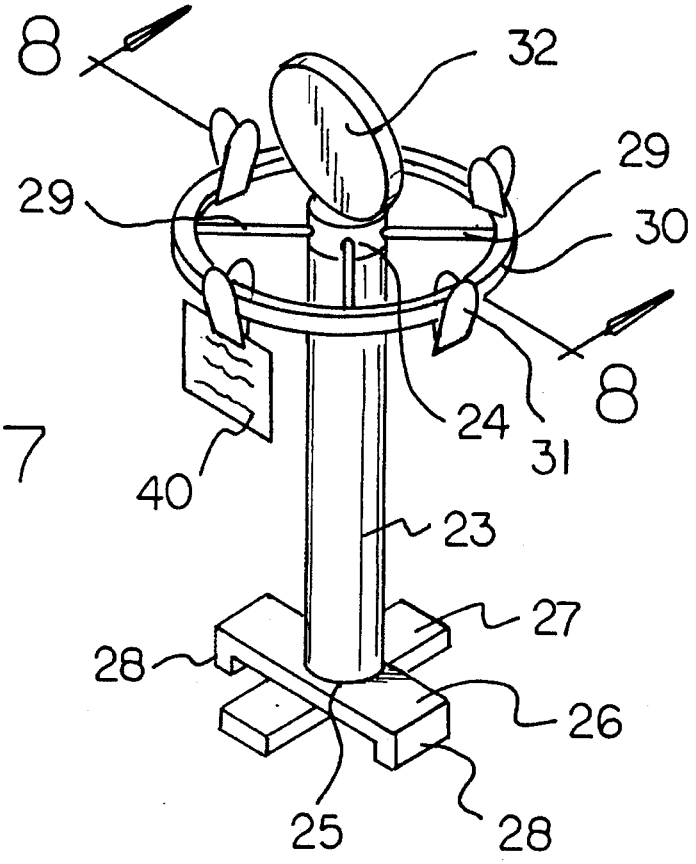
FIG. 7 is a perspective view of the rotatable ring stand of such unit.

FIG. 7 is a perspective view of the "urgent affairs" area showing the shaft 23 supported on stabilizing foot member 25, collar 24, rotatable ring 30 affixed thereto by struts 29, note clips 31 with a note 40 in one of such clips and vertical disc 32 at the top of shaft 23.

Figure 8:
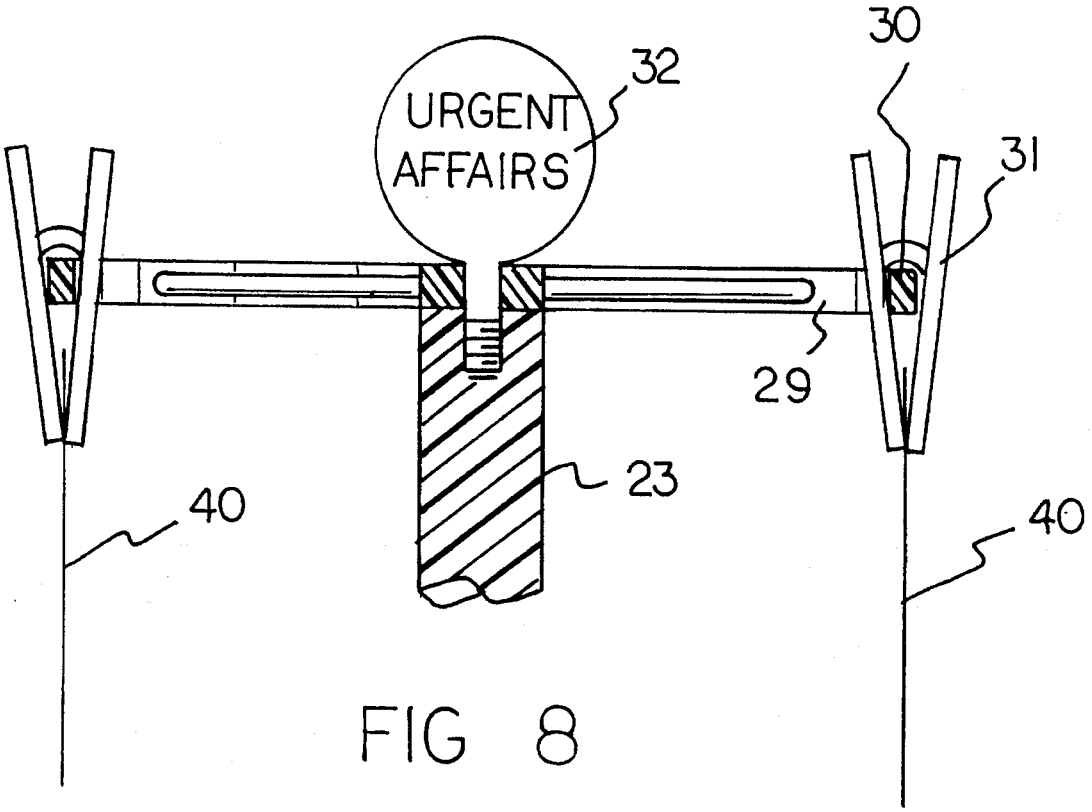
FIG. 8 is an enlarged sectional view on line 8—8 of FIG. 7.

FIG. 8 is a detailed view of such disc 32 along with collar 24, struts 29, clips 31 and notes 40 therein.

Preferably the entire structure of the organizer unit 10 is made from a high impact plastic of any of the types well known in the art. However, if desired, some of the components lend themselves to being made of steel for increased durability, e.g. ring 30 and struts 29, connecting rod 19, and the various note clips such as 15 and the like.

As to the maner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved free-standing desk organizer which comprises: a flat base member forming a first level; an elevated rectangular platform secured to said base member and forming a second level; a plurality of spaced vertical members secured to both said first and said second level, said spaced members forming groups distinct one from another; a plurality of note clips supported by said vertical members; and indicia supported by at least one of such vertical members in each such group identifying areas of varying urgency of action to be taken with respect notes placed in said note clips.

2. An organizer as in claim 1 wherein a row of seven small clip board members is affixed adjacent the front of said base member at said first level and extending parallel to the front edge of said base member, each of said clip board members carrying on the face thereof indicia specifying a different day of the week.

3. An organizer as in claim 2 wherein a pair of vertical support members are mounted on said elevated platform forming said second level and positioned immediately behind the row of clip board members; a small diameter rod extending between and connected to the upper portions of said support members; a plurality of note clips affixed to and supported by said rod; and a vertical post affixed to one of said support members, said post carrying on its upper end indicia identifying a pending affairs area.

4. An organizer as in claim 3 wherein a vertical shaft member is mounted on said second level, laterally disposed from said support members; a stabilizing foot member affixed to the base of said shaft and supported on said second level; a rotatable collar member surrounding the upper end of said shaft; a rigid ring shaped member spaced from and supported by said collar and rotatable therewith; a plurality of spaced note clips depending from said ring; and a vertical disc affixed to the top of said shaft and bearing on its surface indicia identifying it as the urgent affairs area.

5. An organizer as in claim 1 wherein a cylindrical pedestal is also mounted on said second level, said pedestal having a flat upper surface to support a decorative article thereon.

6. An organizer as in claim 1 wherein a further vertical support member is affixed to the rear edge of the first level formed by said base and supports a calendar thereon.

* * * * *